US008196357B2

(12) United States Patent
Mouyiaris

(10) Patent No.: US 8,196,357 B2
(45) Date of Patent: Jun. 12, 2012

(54) PORTABLE BARRIER

(76) Inventor: Nikos Mouyiaris, New York, NY (US)

( * ) Notice: Subject to any disclaimer, the term of this patent is extended or adjusted under 35 U.S.C. 154(b) by 682 days.

(21) Appl. No.: 11/899,640

(22) Filed: Sep. 7, 2007

(65) Prior Publication Data

US 2009/0064598 A1 Mar. 12, 2009

(51) Int. Cl.
*E04B 1/34* (2006.01)

(52) U.S. Cl. ..... 52/2.11; 52/79.5

(58) Field of Classification Search ..... 52/2.11, 52/2.21, 2.22, 2.19, 79, 79.5, 578; 256/19; 135/40

See application file for complete search history.

(56) References Cited

U.S. PATENT DOCUMENTS

| | | | | |
|---|---|---|---|---|
| 3,629,875 | A * | 12/1971 | Dow et al. | 4/599 |
| 4,006,702 | A | 2/1977 | St Cyr | |
| 4,824,282 | A | 4/1989 | Waldecker | |
| 5,269,623 | A | 12/1993 | Hanson | |
| 5,493,816 | A * | 2/1996 | Willemsen | 52/2.11 |
| 5,720,678 | A * | 2/1998 | Korthauer | 473/415 |
| 6,332,290 | B1 * | 12/2001 | Delamare | 52/2.22 |
| 6,467,221 | B1 * | 10/2002 | Bigelow | 52/2.17 |
| 6,641,329 | B1 | 11/2003 | Clement | |
| 2004/0047688 | A1 | 3/2004 | Clement | |
| 2007/0237586 | A1 * | 10/2007 | Prestininzi | 405/115 |
| 2007/0243021 | A1 * | 10/2007 | Tyler | 405/115 |

FOREIGN PATENT DOCUMENTS

| | | |
|---|---|---|
| CA | 2229525 | 8/1999 |
| JP | 2001317018 | 11/2001 |
| WO | WO 2005/090898 A1 * | 9/2005 |

* cited by examiner

*Primary Examiner* — Brian Glessner
*Assistant Examiner* — Adam Barlow
(74) *Attorney, Agent, or Firm* — Day Pitney LLP

(57) ABSTRACT

A portable and collapsible barrier that is lightweight and can be easily transported and erected. The barrier includes a base, a top and an enclosed volume such as a diaphragm that can be expanded with a medium such as a gas or liquid to a desired shape. The expanded volume will act as a barrier. When a series of expanded barriers are connected, they will form a wall that can contain bulk materials or liquids.

23 Claims, 4 Drawing Sheets

PORTABLE BARRIER

BACKGROUND OF THE INVENTION

1. Field of the Invention

The inventions described herein relate to a portable and collapsible barrier unit that is lightweight and can be easily transported and erected. The barrier unit includes a diaphragm that can be expanded with a medium to a desired shape that will act as a barrier. Each barrier unit can be used alone or with other barrier units to create a wall.

2. Description of the Related Art

Different types of portable barriers exist for different situations. For example, saw horses or metal gates are sometimes used to contain crowds. A problem with saw horses, metal gates and other similar barriers is they can not contain bulk materials and liquids such as soil, grain or water. Such bulk materials and liquids require barriers that, for example, can span large distances, can hold back the weight of bulk materials and liquids and do not have any holes that would allow the bulk materials or liquids to pass through the barrier.

SUMMARY OF THE INVENTION

The inventions described herein include a portable, collapsible, lightweight barrier unit. Each barrier unit has a rigid base, which can be a carrying case with a top, and an inflatable enclosed volume such as a flexible diaphragm that rests on the base. The side walls of the volume can have any constructions such as an accordion-like construction. The volume can be secured to the base. The volume will have an inlet hole through which a medium such as a gas or liquid can be pumped into the volume to inflate the volume. When the volume is inflated, the volume will act as a barrier for holding back bulk materials or liquids. Each barrier unit can be anchored using, for example, ballast.

A number of barrier units can be connected together to form a wall or corral. The barriers can be connected using any conventional techniques. The barrier units can be sealed together using any conventional technique to prevent bulk materials or liquids from seeping between the barrier units. The barrier units can also be sealed to the ground to prevent the bulk materials or liquids from seeping underneath the barrier units. Each enclosed volume of each barrier unit can be connected to separate mediums sources or can be connected in parallel to the same medium source. In addition, the volumes of the barrier units can be connected in series so the medium enters one volume to inflate that volume and then can exit that volume and enter the next volume to inflate that volume and then continue on to the other volumes.

An object of the inventions is to provide a portable, collapsible, lightweight barrier unit.

Another object of the inventions is to provide a barrier unit that can contain bulk materials and liquids such as soil, grain or water.

Another object of the inventions is to provide a portable barrier unit that can be transported to a site and easily erected.

Another object of the inventions is to provide a barrier unit that can be easily and cost effectively manufactured.

Another object of the inventions is to provide a barrier unit that can be a temporary barrier and that can be reused.

BRIEF DESCRIPTION OF DRAWINGS

The accompanying drawings illustrate the inventions described herein and, together with the Detailed Description below, help to describe the inventions. The reference numerals in the drawings refer to the same or like elements and are used in the Detailed Description to refer to the same or like elements. Below are brief descriptions of the drawings.

DETAILED DESCRIPTION OF THE PREFERRED EMBODIMENTS

Figure 1:
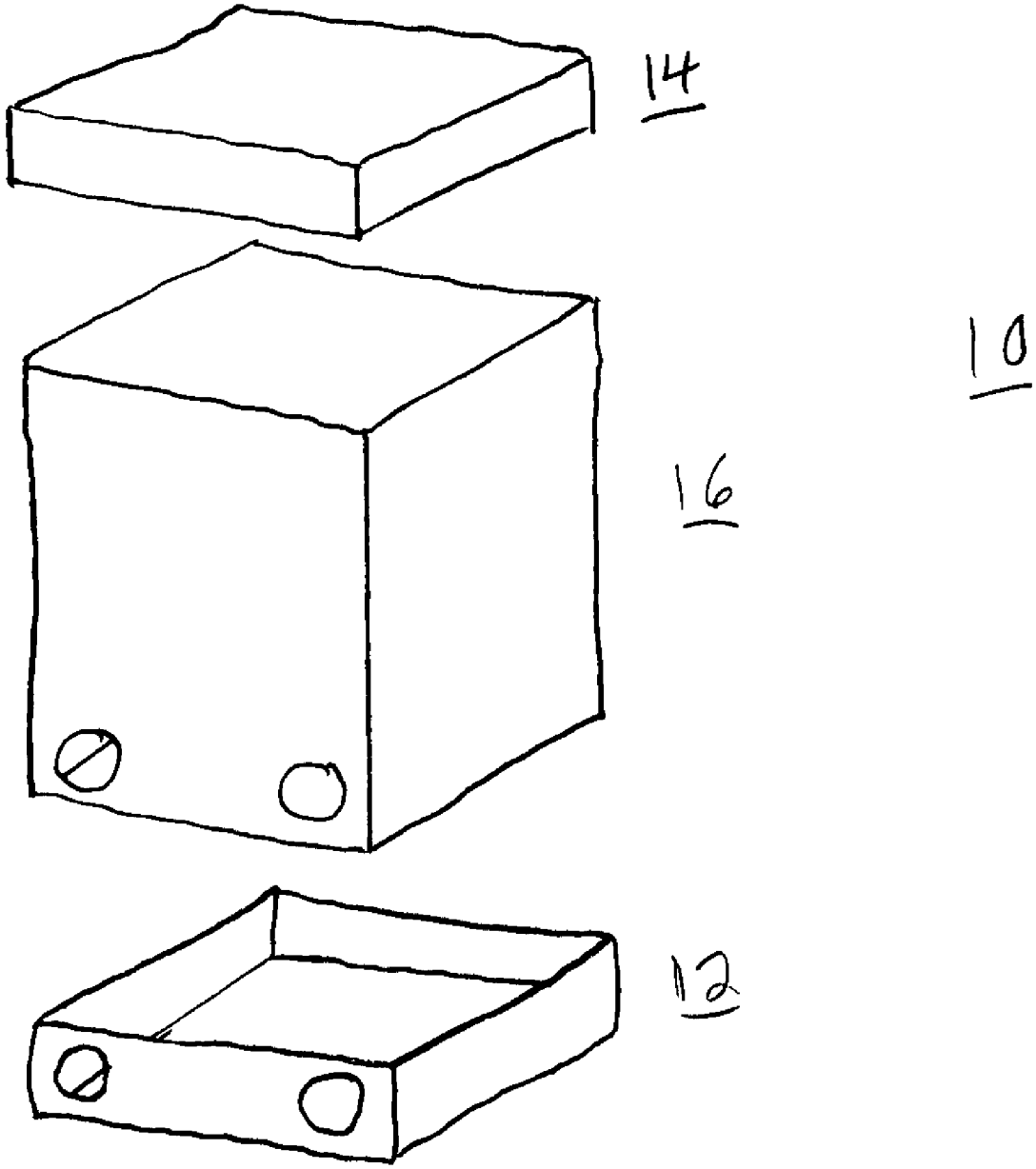
FIG. 1 is an exploded view of the portable barrier unit in accordance with an embodiment of the present inventions.

FIG. 1 illustrates several components of a portable barrier unit 10. Barrier unit 10 consists of a rigid base 12, a rigid top 14 and an expandable volume or flexible diaphragm 16.

Figure 2:
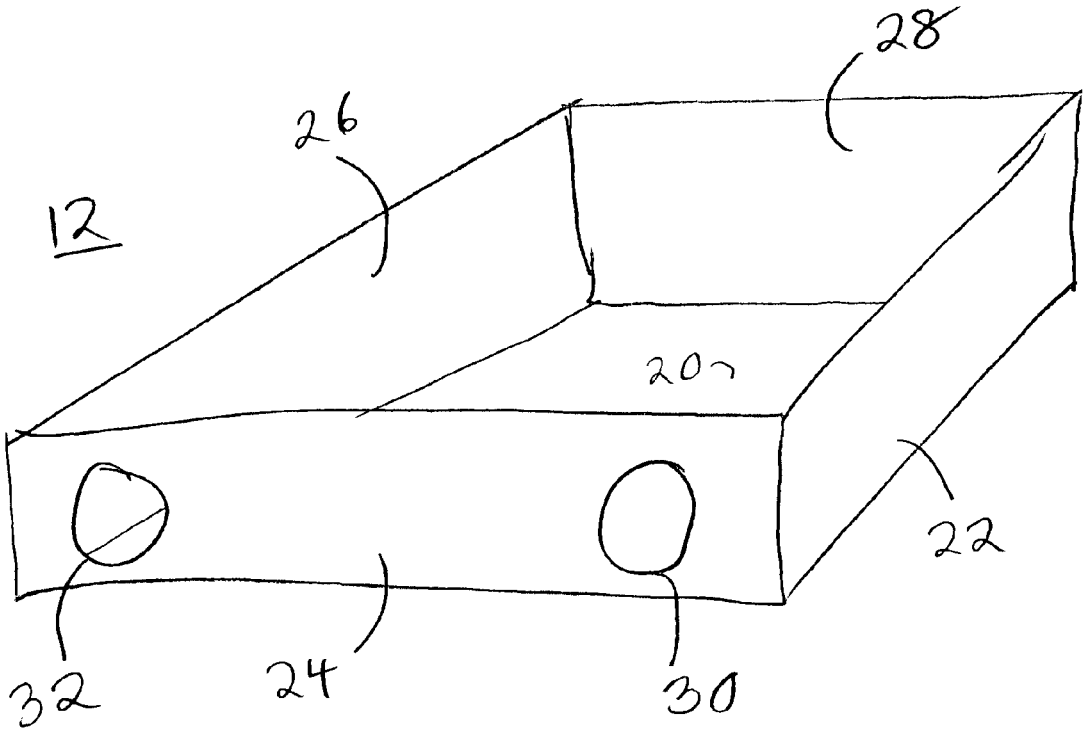
FIG. 2 is a perspective view the base of the portable barrier unit in accordance with an embodiment of the present inventions.

FIG. 2 illustrates base 12. Base 12 has a bottom 20 and four side walls 22, 24, 26, 28, all of which form a tray-like structure with an open top. Side wall 24 has an inlet hole 30 and an outlet hole 32.

Figure 3:
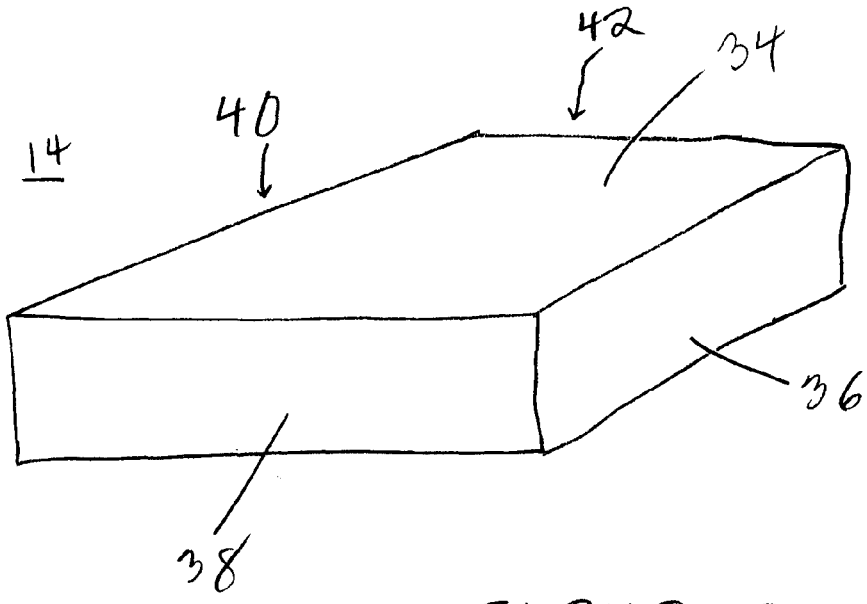
FIG. 3 is a perspective view the top of the portable barrier unit in accordance with an embodiment of the present inventions.

FIG. 3 illustrates top 14. Top 14 has a top 34 and four side walls 36, 38, 40, 42, all of which form an upside down tray-like structure with an open bottom.

Base 12 and top 14 can be made out of any lightweight, rigid material. One such material is plastic. In addition, base 12 and top 14 can be of any construction that will allow the expandable volume or flexible diaphragm 16 to easily expand or inflate without tipping over. Both base 12 and top 14 can be of any construction as long as they help to stabilize the expandable volume or flexible diaphragm 16 while it expands or inflates.

Base 12 and top 14 can be designed to act as a carrying case for the expandable volume or flexible diaphragm 16. In such case, the side walls 22, 24, 26, 28 of base 12 may fit over or engage the side walls 36, 38, 40, 42 of top 14 in any conventional manner. For example, side walls 22, 24, 26, 28 may have a male lip around their top edges and side walls 36, 38, 40, 42 may have a female lip around their top edges. When top 14 is placed on base 12, the two sets of lips engage one another to hold top 14 and base 12 together. Another example is each side wall 22, 24, 26, 28 may have a male portion of a latch at their top edges and each side wall 36, 38, 40, 42 may have a female portion of a latch at their top edges. When top 14 is placed on base 12, the two sets of side walls abut against one another and the latches, when engaged, hold top 14 and base 12 together.

Figure 4:
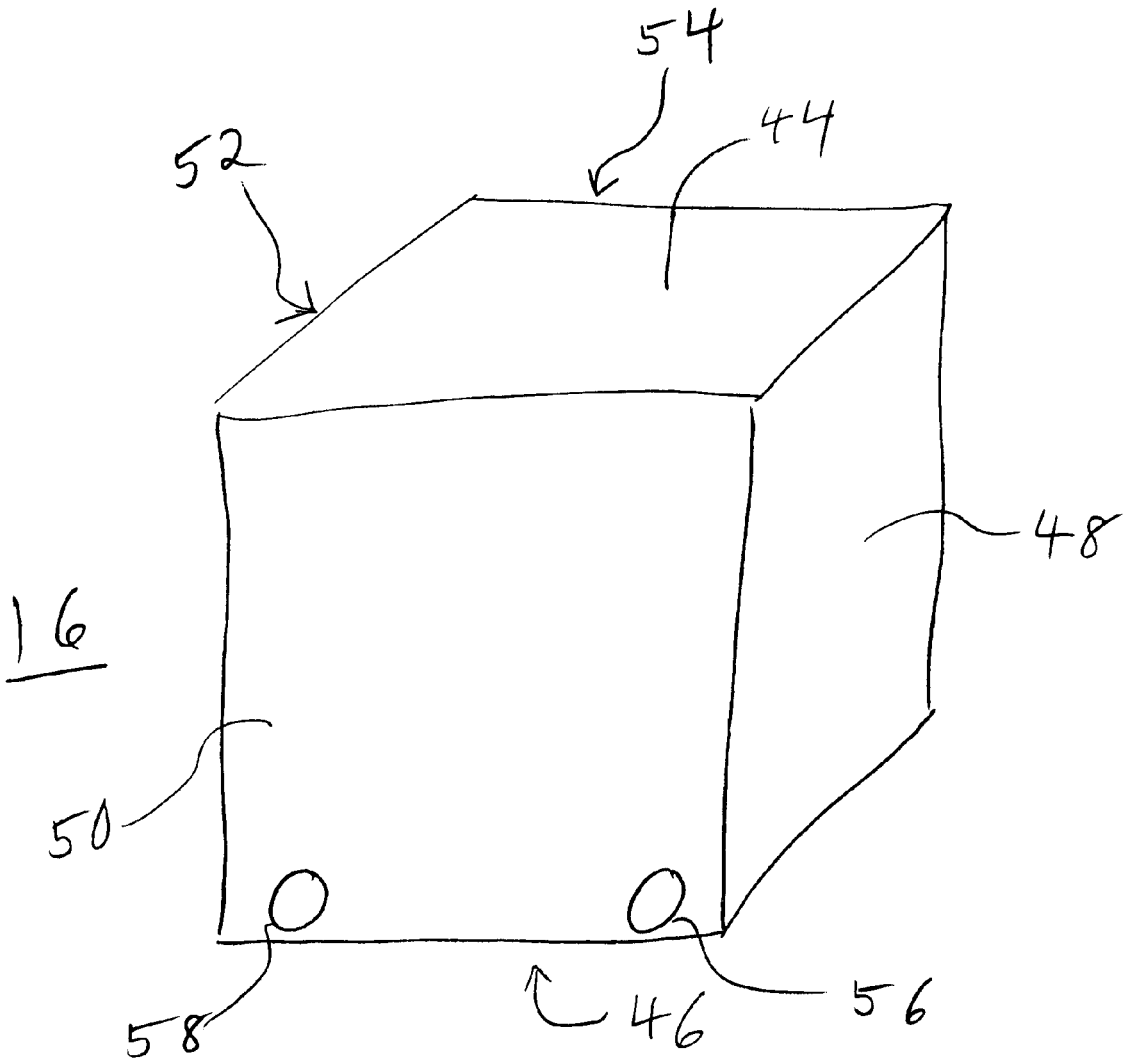
FIG. 4 is a perspective view the diaphragm of the portable barrier unit in accordance with an embodiment of the present inventions.

FIG. 4 illustrates the expandable volume or flexible diaphragm 16. Diaphragm 16 forms an enclosed volume by itself of in conjunction with the base 12 and top 14. Diaphragm 16 can be an enclosed box shape with a top 44, a bottom 46 (not shown) and four side walls 48, 50, 52 (not shown), 54 (not shown). In addition, diaphragm 16 can have an inlet hole 56 and an outlet hole 58. In some embodiments, diaphragm 16 may not have a top 44 or a bottom 46. Diaphragm 16 is made out of any material that is flexible and that can expand but is preferably a lightweight material such as vinyl.

The bottom of diaphragm 16 fits into or is secured to base 12 and the top of diaphragm 16 fits into or is secured to top 14. Diaphragm 16 can be secured into base 12 and top 14 using any conventional means such as fasteners, glue or form fit techniques. If side walls 48, 50, 52, 54 of diaphragm 16 are sealed to side walls 22, 24, 26, 28 of base 12 and side walls 36, 38, 40, 42 of top 14, then diaphragm 16 does not need its top 44 or bottom 46 since top 14 and base 12 will acts as the top and bottom of diaphragm 16.

When the bottom of diaphragm 16 is inserted into base 12, inlet hole 56 and outlet hole 58 of diaphragm 16 will line up with inlet hole 30 and outlet hole 32 of base 12, respectively. Inlet hole 56 and outlet hole 58 of diaphragm 16 and inlet hole 30 and outlet hole 32 of base 12 will be connected and sealed together using any conventional means. For example, inlet hole 56 and outlet hole 58 of diaphragm 16 may have extra material that is pulled through inlet hole 30 and outlet hole 32 of base 12, respectively, and a ring is placed around inlet hole 30 and outlet hole 32 of base 12. Another example is inlet hole 56 and outlet hole 58 of diaphragm 16 may have extra material that is pulled through inlet hole 30 and outlet hole 32 of base 12, respectively, and glued to side 24 of base 12.

The cross-sectional shape of barrier unit 10 and, thus, of base 12, top 14 and expandable volume or flexible diaphragm 16, is a square. The cross-sectional shape of barrier unit 10, however, can be any shape such as a circle, oval, rectangle, triangle or any other polygon or circular shape.

Expandable volume or flexible diaphragm 16 is an enclosed volume that acts like a balloon. Diaphragm 16 begins in a collapsed state. A medium such as water or air (not shown) is pumped into inlet hole 30 using any conventional means such as a pump or air compressor. Outlet hole 32 is closed or topped using any conventional means so that the interior of diaphragm 16 is sealed and no medium can escape from outlet hole 32. As more and more medium enters the interior of diaphragm 16, diaphragm 16 will expand or inflate. When diaphragm 16 has fully expanded, diaphragm 16 will form a rectangular column, as shown in FIG. 1.

Figure 5:
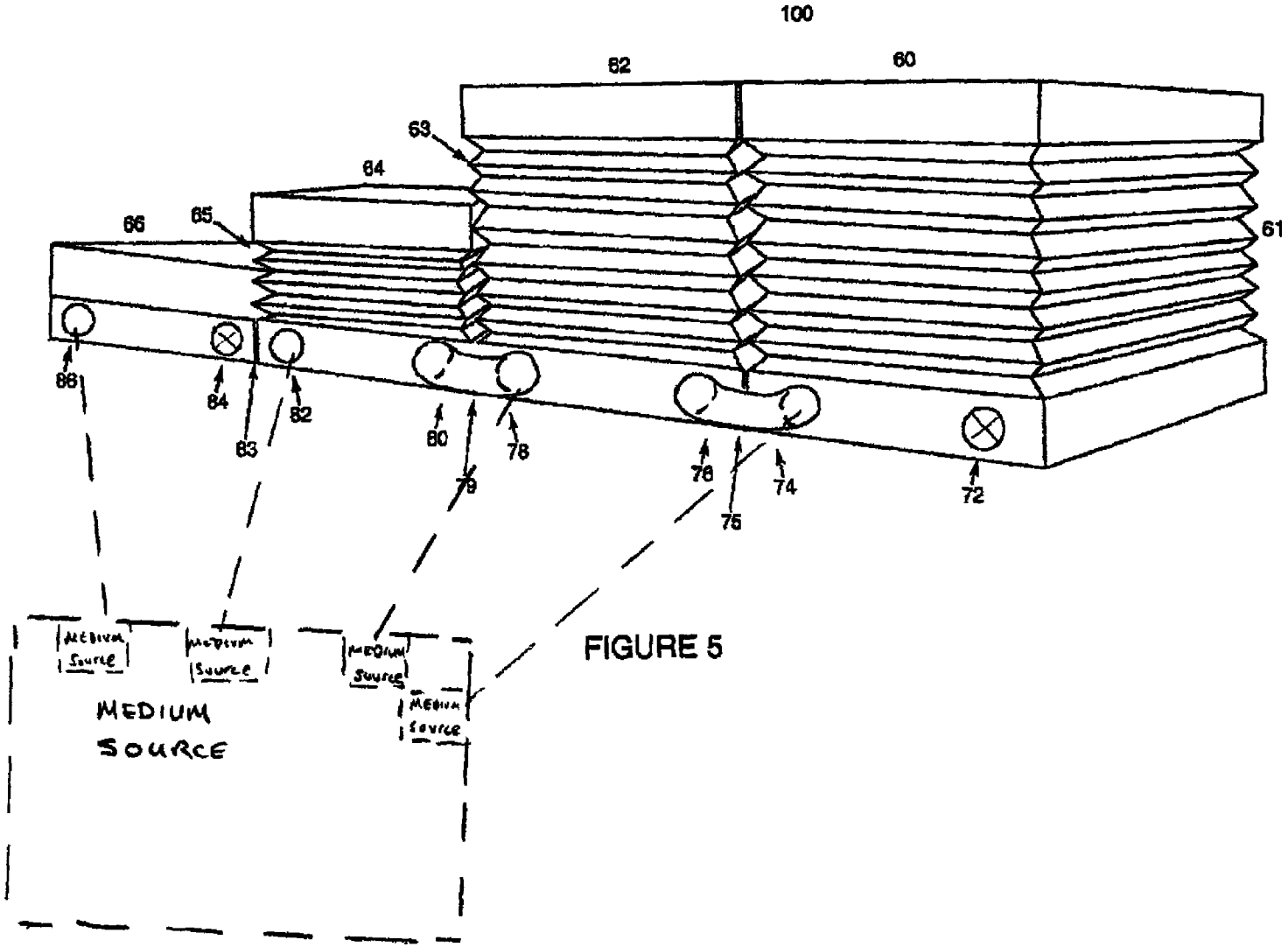
FIG. 5 is a perspective view of a series of portable barrier units in accordance with an embodiment of the present inventions.

Expandable volume or flexible diaphragm 16 can be of any construction that will allow diaphragm 16 to be carried inside base 12 and top 14 and to expand upward. As shown in FIGS. 1-4, diaphragm 16 is a box shape constructed of flexible material. FIG. 5 illustrates a number of barriers with diaphragms that have accordion-like side walls. As shown in FIG. 5, barrier unit 60 has an accordion-like diaphragm 61, barrier unit 62 has an accordion-like diaphragm 63, and barrier unit 64 has an accordion-like diaphragm 65. Barrier unit 66 also has an accordion-like diaphragm but the diaphragm is not shown since barrier unit 66's top is on its base in a closed position. The accordion-like diaphragms can be made of any material that are flexible enough to expand but stiff enough to fold up in an accordion-like fashion. In addition, the accordion-like diaphragms can be constructed without a bottom and a top in a manner previously described above. If the diaphragms do not have a top or bottom, the sides of the diaphragms will need to be secured and sealed to the bases and tops to create an enclosed volume.

In operation, barrier unit 10 is transported in a closed position. Next, barrier unit 10 is placed in a site where a barrier needs to be erected. Next, a medium such as water or air (not shown) is pumped into inlet holes 30, 56 using any conventional means such as a pump or air compressor while outlet holes 32, 58 are closed or topped using any conventional means so that the interior of expandable volume or flexible diaphragm 16 is sealed and no medium can escape from outlet holes 32, 58. As more and more medium enters the interior of diaphragm 16, diaphragm 16 will begin to expand or inflate. As diaphragm 16 expands, diaphragm 16 will lift top 14 upwards off of base 12. When diaphragm 16 has fully expanded, the pumping of the medium is stopped. When use of the barrier is complete, the medium is let out of diaphragm 16 by opening outlet holes 32, 58. When diaphragm 16 is collapsed, diaphragm 16 is packed into base 12, and top 14 is placed back onto base 12. Thus, barrier unit 10 can be transported to another site and reused.

Any medium can be used as long as it is suitable for the intended use of barrier unit 10. For example, air as a medium may not be heavy enough to allow barrier unit 10 to hold back heavy bulk products such as coal. In such cases, the barrier unit 10 can be anchored using conventional techniques such as using rocks or weights as ballast in base 12 to hold barrier unit 10 in place. Alternatively, a heavier medium such as water can be used and ballast may not be necessary. Inlet holes 30, 56 and outlet holes 32, 58 can be connected to any type of valve and/or pump depending on the use of barrier unit 10 and the medium pumped into barrier unit 10.

FIG. 5 illustrates a number of barrier units connected together in series to form a barrier system or wall 100. Barrier unit 60 is placed next to barrier unit 62. Barrier unit 62 is placed next to barrier unit 64. Barrier unit 64 is placed next to barrier unit 66. The barriers can be connected to one another using any conventional means such as latches, tape or straps.

In operation, barriers 60, 62, 64 and 66's inlet and outlet holes are connected to allow the medium to flow from one diaphragm to another diaphragm. Inlet hole 72 of barrier unit 60 is connected to a source of a medium such as a water pump using any conventional means such as a pipe. As the medium is pumped into expandable volume or flexible diaphragm 61 of barrier unit 60, diaphragm 61 will expand.

Outlet hole 74 of barrier unit 60 is connected to inlet hole 76 of barrier unit 62 by a pipe 75. As the medium is pumped into expandable volume or flexible diaphragm 61 of barrier unit 60, at some point such as when diaphragm 61 is fully expanded, the medium will flow through pipe 75 into expandable volume or flexible diaphragm 63 of barrier unit 62.

Outlet hole 78 of barrier unit 62 is connected to inlet hole 80 of barrier unit 64 by a pipe 79. As the medium is pumped into expandable volume or flexible diaphragm 63 of barrier unit 62, at some point such as when diaphragm 63 is fully expanded, the medium will flow through pipe 79 into expandable volume or flexible diaphragm 65 of barrier unit 64.

Outlet hole 82 of barrier unit 64 is connected to inlet hole 84 of barrier unit 66 by a pipe 83. As the medium is pumped into expandable volume or flexible diaphragm 65 of barrier unit 64, at some point such as when diaphragm 65 is fully expanded, the medium will flow through pipe 83 into expandable volume or flexible diaphragm (not shown) of barrier unit 66.

Outlet hole 86 of barrier unit 66 is closed and sealed to prevent any medium from escaping the diaphragm of barrier unit 66 and also from escaping barrier system 100. When the diaphragms of barriers 60, 62, 64, 66 are expanded, their side walls that abut one another will push against each other to form a continuous surface or wall. Thus, barriers 60, 62, 64, 66 will form a rectangular wall that can act as a barrier for large bulk materials and liquids.

One can connect as many barriers as one desires to construct a wall of any length or to create a corral or holding area of any shape. When one connects the barriers, one may seal the barriers together using any conventional technique such as tape, foam or flexible inserts to prevent bulk materials and liquids from seeping between the barriers. In addition, one may seal the area around the base of the barriers to prevent bulk materials and liquids from seeping underneath the barriers. For example, one may embed the barriers in the ground or pile soil or sand against the base of the barriers to form the seal.

One may connect the inlet and outlet holes of the barriers in any fashion such as in series or in parallel. One may also not connect the inlet and outlet holes of the barriers. In such cases, the outlet holes are closed and the inlet holes are connect to one or more pumps or other devices that supply the medium to expand the diaphragms.

Sample applications of a series of barriers include: connecting a series of barriers together to act as a flood wall or to repair a hole in a levee or to retain bulk materials such as coal or rock salt in a specific area.

Depending on the application, the height of barrier unit 10 may be controlled using the medium or the height is pre-set. In general, the height of barrier unit 10 corresponds to the height of enclosed volume or flexible diaphragm 16's four side walls 48, 50, 52, 54. The height can be adjusted by pumping more or less medium into diaphragm 16. If diaphragm 16 is not fully expanded and is next to another diaphragm that is not fully expanded, then bulk material or liquid may be able to pass between the diaphragms. Therefore, in cases where the diaphragms must be fully expanded, the height of barrier unit 10 will be pre-set by constructing diaphragm 16's four side walls 48, 50, 52, 54 to be a pre-selected height that may be based on factors such as the size of the barrier wall or the amount of bulk material or liquid that needs to be contained.

The purpose of the foregoing description of the preferred embodiments is to provide illustrations of the inventions described herein. The foregoing description is not intended to be exhaustive or to limit the inventions to the precise forms disclosed. One of skill in the art will obviously understand many modifications and variations are possible in light of the above principles. The foregoing description explains those principles and examples of their practical applications. The foregoing description is not intended to limit the scope of the inventions that are defined by the claims below.

The invention claimed is:

1. A portable barrier unit, comprising:

a base; a top; a volume;

wherein the volume comprises sidewalls, said sidewalls having a flexible diaphragm construction thereby defining an inflatable enclosed volume between the base and the top, said flexible diaphragm structure allowing variation of the vertical distance between said base and said top thereby varying a height of the unit; and the volume having a first inlet hole;

wherein when said volume is inflated, the inflated volume will act as a barrier and wherein when said barrier unit is connected to another barrier unit, the units will form a barrier wall; and each barrier unit is independently connected and controlled in parallel to one or more medium sources such that one medium source is connected to all barrier units or each barrier unit is connected to its own medium source, thereby allowing various vertical height configurations of the barrier wall by independently varying each barrier unit; and the base and the top form a carrying case for carrying the volume; the case defining a second inlet hole that aligns with the first inlet hole of the volume.

2. A portable barrier unit according to claim 1, further comprising:

the volume is secured to the base and the top.

3. A portable barrier unit according to claim 1, further comprising:

the first and second inlet holes are connected to the medium source, and wherein the medium is used to inflate the volume.

4. A portable barrier unit according to claim 3, further comprising:

the medium is selected from the group consisting of a liquid or a gas.

5. A portable barrier unit according to claim 1, further comprising:

a plurality of barriers attached to the barrier.

6. A portable barrier unit according to claim 1, further comprising: a ballast for anchoring the portable barrier unit.

7. A portable barrier unit according to claim 1, wherein the portable barrier is made of a plastic material.

8. A portable barrier unit according to claim 1, further comprising: the shape of the barrier, base, top and enclosed volume is selected from the group consisting of a polygon, triangle, parallelogram, circle or oval.

9. A portable barrier wall, comprising:

a first barrier unit, comprising: a first base; a first top; and a first volume; wherein the first volume comprises first sidewalls, said first sidewalls having a first flexible diaphragm construction thereby defining a first inflatable enclosed volume between the first base and the first top, said first flexible diaphragm structure allowing variation of the vertical distance between said first base and said first top thereby varying a height of the first unit, a second barrier unit, sealed to the first barrier unit comprising: a second base; a second top; and a second volume; wherein the second volume comprises second sidewalls, said second sidewalls having a second flexible diaphragm construction thereby defining a second inflatable enclosed volume between the second base and the second top, said second flexible diaphragm structure allowing variation of the vertical distance between said second base and said second top thereby varying a height of the second unit, wherein when said first and second volumes are inflated, the first and second volumes together will act as a barrier wall, and each barrier unit is independently connected and controlled in parallel to one or more medium sources such that one medium source is connected to all barrier units or each barrier unit is connected to its own medium source, thereby allowing various vertical height configurations of the barrier wall by independently varying each barrier unit; and the first and second bases, and first and second tops, form first and second carrying cases, respectively; the first and second volumes each have an inlet hole; and the first and second carrying cases each having an inlet hole; and the inlet holes of the first and second volumes align with the inlet holes of the first and second carrying cases.

10. A portable barrier wall according to claim 9, further comprising: the first and second volumes are secured to the first and second bases and first and second tops, respectively.

11. A portable barrier wall according to claim 9, further comprising: the first volume has an outlet hole, and the outlet hole is connected to the inlet hole of the second volume, and the outlet hole is closed.

12. A portable barrier wall according to claim 9, further comprising: at least one of the inlet holes of the first and second volumes connected to the medium source, wherein the medium is used to inflate at least one of the first and second volumes.

13. A portable barrier wall according to claim 9, wherein each of the inlet holes of the first and second volumes is connected to a separate medium source, and wherein the medium is used to inflate the first and second volumes.

14. A portable barrier wall according to claim 12, further comprising: the medium is selected from the group consisting of a liquid or a gas.

15. A portable barrier wall according to claim 9, further comprising: the first barrier is attached to the second barrier.

16. A portable barrier wall according to claim 9, further comprising: a ballast for the first barrier and a ballast for the second barrier.

17. A portable barrier wall according to claim 9, further comprising: the shape of the barriers, bases, tops and enclosed volumes is selected from the group consisting of a polygon, triangle, parallelogram, circle or oval.

18. A method of erecting a portable barrier unit, comprising:

opening a carrying case containing a base and top, the carrying case defining an inlet hole;

positioning the base with the top;

positioning a volume comprising sidewalls, said sidewalls having a flexible diaphragm construction thereby defining an enclosed volume between the base and the top, said flexible diaphragm structure allowing variation of the distance between said base and said top thereby varying a height of the unit; the volume having an inlet hole that aligns with the inlet hole of the carrying case;

inflating the enclosed volume to form a barrier unit;

connecting said barrier unit to another barrier unit, to form a barrier wall; and individually adjusting the units for height, wherein each barrier unit is independently connected and controlled in parallel to one or more medium sources such that one medium source is connected to all barrier units or each barrier unit is connected to its own medium source, thereby allowing various vertical height configurations of the barrier wall by independently varying each barrier unit at the same time.

19. A method of erecting a portable barrier unit according to claim 18, further comprising:

inflating the volume by pumping a medium into the volume.

20. A method of erecting a portable barrier unit according to claim 18, further comprising: anchoring the base.

21. A method of erecting a portable barrier unit according to claim 18, wherein inflating the volume of the barrier units occur to produce different heights.

22. A portable barrier unit comprising:

a base; a top; and an inflatable enclosed volume comprising sidewalls, wherein when said volume is inflated with a medium, the inflated volume will act as a barrier and wherein said barrier unit is connected to another barrier unit, the units will form a barrier wall, and said sidewalls having a flexible diaphragm structure whereby the sidewalls are capable of individual vertical adjustment for height wherein each barrier unit is independently connected and controlled in parallel to one or more medium sources such that one medium source is connected to all barrier units or each barrier unit is connected to its own medium source, thereby allowing various vertical height configurations of the barrier wall by independently varying each barrier unit at the same time; the volume having a first inlet hole; and the base and cap form a carrying case for carrying the volume, the carrying case defining a second inlet hole that aligns with the first inlet hole of the volume.

23. A method of erecting a portable barrier unit comprising:

opening a carrying case containing a base and a top;

inflating an enclosed volume with a medium to expand, wherein said expanded volume acts as a barrier and wherein when said barrier unit is connected to another barrier unit, the units will form a barrier wall;

wherein the volume has sidewalls having a flexible diaphragm structure whereby the sidewalls may individually and vertically adjust the units for height, wherein each barrier unit is independently connected and controlled in parallel to one or more medium sources such that one medium source is connected to all barrier units or each barrier unit is connected to its own medium source, thereby allowing various vertical height configurations of the barrier wall by independently varying each barrier unit at the same time; the volume having a first inlet hole; and the carrying case for carrying the volume, the carrying case defining a second inlet hole that aligns with the first inlet hole of the volume.

* * * * *